US011248308B2

(12) United States Patent
Ogata et al.

(10) Patent No.: US 11,248,308 B2
(45) Date of Patent: Feb. 15, 2022

(54) SUBSTRATE HOLDER AND PLATING APPARATUS WITH SUBSTRATE HOLDER

(71) Applicant: EBARA CORPORATION, Tokyo (JP)

(72) Inventors: Shoichiro Ogata, Tokyo (JP); Matsutaro Miyamoto, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 16/790,566

(22) Filed: Feb. 13, 2020

(65) Prior Publication Data

US 2020/0263316 A1 Aug. 20, 2020

(30) Foreign Application Priority Data

Feb. 20, 2019 (JP) ..... JP2019/028126

(51) Int. Cl.
*C25D 17/08* (2006.01)
*C25D 17/00* (2006.01)
*C25D 17/06* (2006.01)

(52) U.S. Cl.
CPC ..... *C25D 17/08* (2013.01); *C25D 17/004* (2013.01); *C25D 17/06* (2013.01)

(58) Field of Classification Search
CPC ..... C25D 17/004; C25D 17/06; C25D 17/08; C25D 17/001
See application file for complete search history.

(56) References Cited

U.S. PATENT DOCUMENTS 6,645,356 B1 * 11/2003 Woodruff ..... C25D 17/001 204/224 R
6,939,448 B2 * 9/2005 Batz, Jr. ..... C25D 17/06 204/224 R
2003/0010641 A1 * 1/2003 Kholodenko ..... C25D 17/06 205/80
2013/0306465 A1 * 11/2013 Zimmerman ..... F16J 15/00 204/242
2016/0108539 A1 * 4/2016 Yahagi ..... C25D 17/001 204/242
2017/0009369 A1 * 1/2017 Berke ..... C25D 17/005

FOREIGN PATENT DOCUMENTS

JP 2018-040045 A 3/2018

* cited by examiner

*Primary Examiner* — Alexander W Keeling
*Assistant Examiner* — Mofoluwaso S Jebutu
(74) *Attorney, Agent, or Firm* — BakerHostetler

(57) ABSTRACT

A substrate holder prevents a substrate to be bent or damaged owing to inward declining of a seal lip. The substrate holder with an opening includes a seal, and a seal support which has a seal support surface, and is formed on an outer circumference of the opening. The seal includes a seal body and a seal lip. At least a part of the seal support surface has an inclination angle that allows an inner end of the seal support surface to approach the plane on which the substrate is to be positioned. The inner end of the seal support surface is positioned on an inner side than the seal lip.

14 Claims, 13 Drawing Sheets

SUBSTRATE HOLDER AND PLATING APPARATUS WITH SUBSTRATE HOLDER

TECHNICAL FIELD

The present invention relates to a substrate holder and a plating apparatus provided with the substrate holder.

The present application claims priority from Japanese patent application JP2019-28126 filed on Feb. 20, 2019. The all disclosures including the specification, claims, drawings, and abstract are incorporated by reference in its entirety into this application.

BACKGROUND ART

A substrate holder for holding a substrate has been used in treatment such as plating treatment. The substrate holder exposes at least a part of the substrate on at least one of surfaces via an opening. A seal provided for the substrate holder separates an exposed part of the substrate from the other part. Typically, as disclosed in PTL 1 (see especially FIG. 15), the seal including a seal lip is pressed in a direction perpendicular to a substrate surface.

CITATION LIST

Patent Literature

PTL 1: Japanese Patent Laid-Open No. 2018-040045

SUMMARY OF INVENTION

Technical Problem

When the seal is pressed in the direction perpendicular to the substrate surface depending on a shape, the seal lip may decline toward the center of the opening (to the left side as shown in FIG. 15 of PTL1). Declining toward the center of the opening, the seal lip pushes the substrate toward the center of the opening. Generally, the seal is disposed over entire circumference of the opening. Accordingly, the substrate receives the force directed toward the center of the opening from substantially all directions.

The force received by the highly rigid substrate from the seal is substantially negligible. In the recent years, various types of the substrates are used. Rigidity of the substrate may be deteriorated depending on its thickness, size, material and the like. When the substrate with low rigidity is used, the substrate may be bent or damaged owing to the declining of seal lip.

It is an object of the present invention to solve at least a part of the above-described problems.

Solution to Problem

An embodiment according to the present invention discloses a substrate holder with an opening for exposing at least a part of a substrate on at least one of surfaces. The substrate holder includes a seal which comes in contact with a surface including the part of the substrate to be exposed, and is pressed in a direction perpendicular to a plane on which the substrate is to be positioned, and a seal support which has a seal support surface for supporting the seal, and is disposed on an outer circumference of the opening. The seal includes a seal body which comes in contact with the seal support surface, and a seal lip which extends from the seal body to come in contact with the surface of the substrate to be exposed. At least a part of the seal support surface has an inclination angle which allows an inner end of the seal support surface to approach the plane on which the substrate is to be positioned. The inner end of the seal support surface is positioned on an inner side than the seal lip.

DESCRIPTION OF EMBODIMENTS

<Plating Apparatus>

Figure 1A:
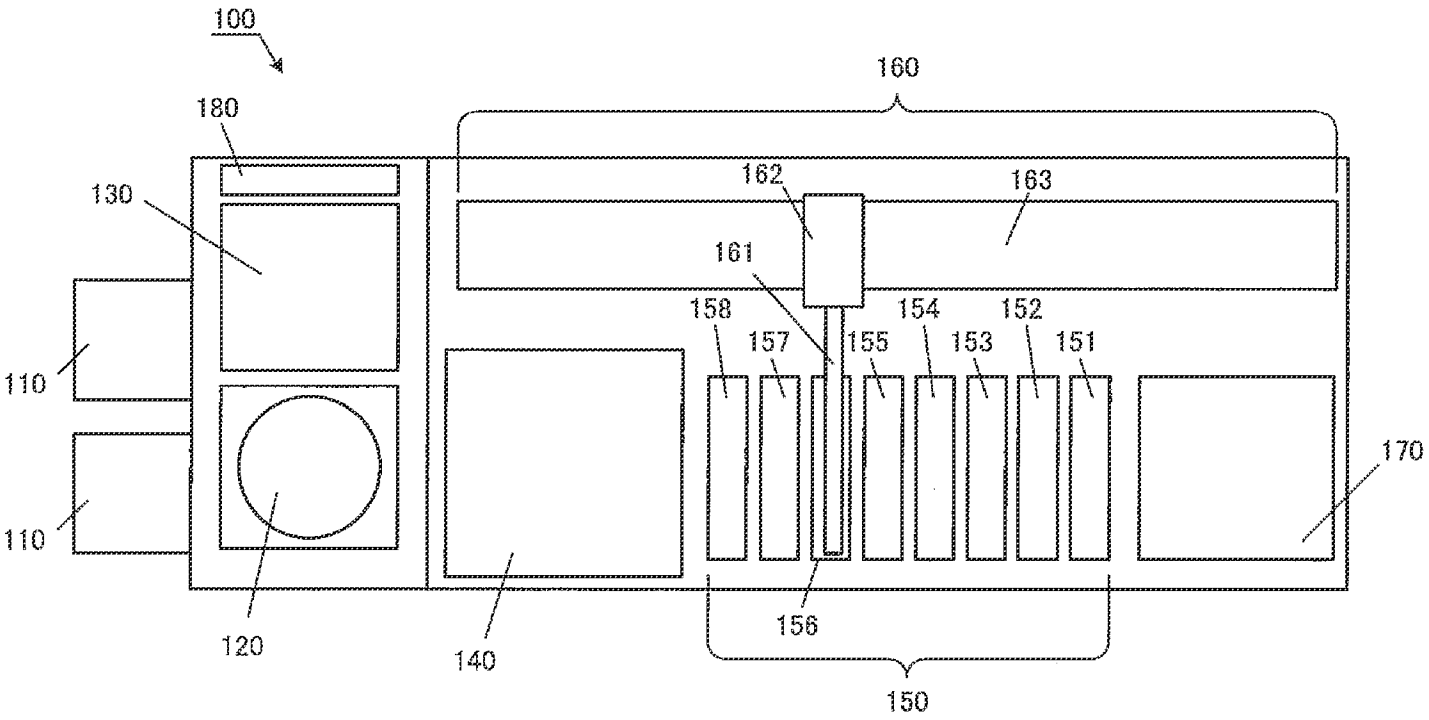
FIG. 1A is a top view of a plating apparatus.
Figure 1B:
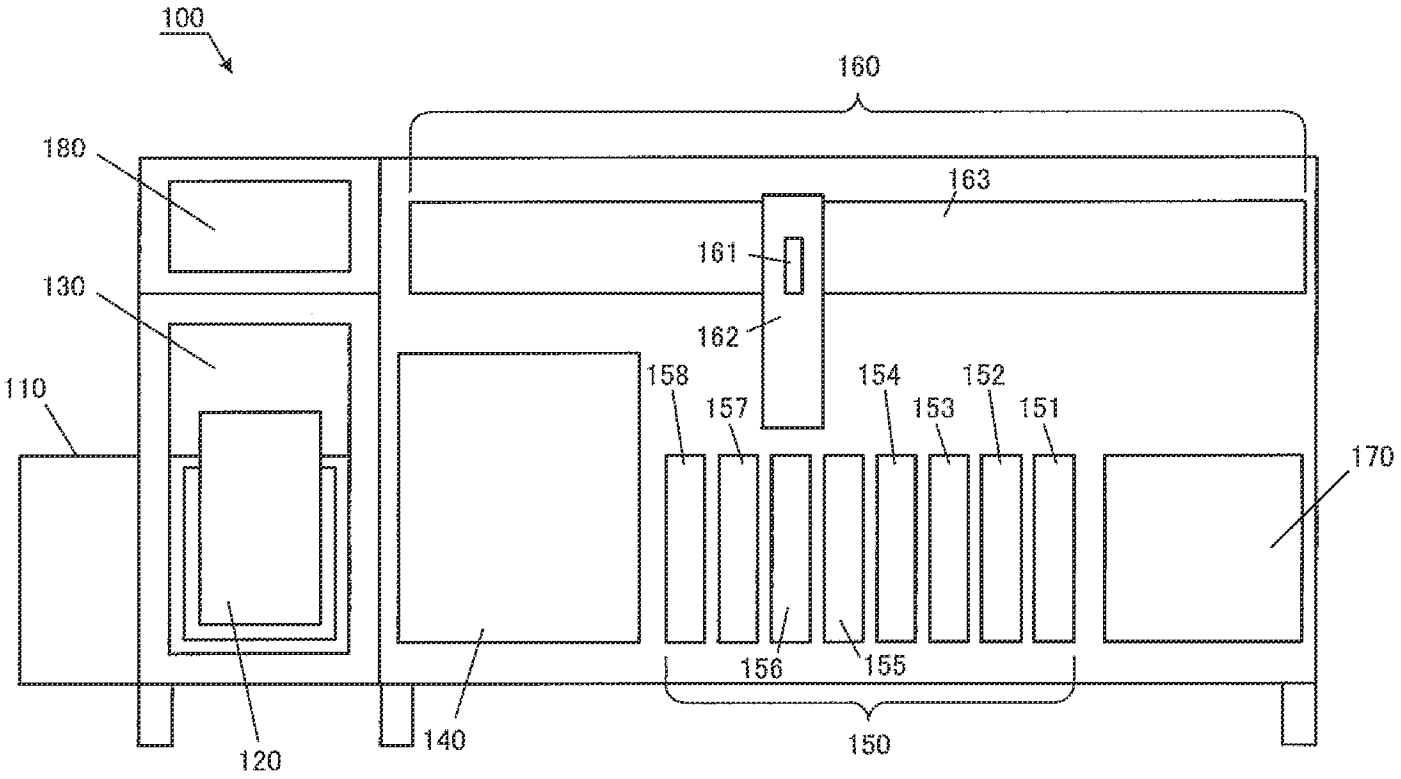
FIG. 1B is a side view of the plating apparatus.

FIGS. 1A and 1B are views schematically showing a plating apparatus 100 according to an embodiment. FIG. 1A is a top view of the plating apparatus 100. FIG. 1B is a side view of the plating apparatus 100. The plating apparatus 100 according to the embodiment includes a load port 110, a transfer robot 120, a drier 130, an attachment/detachment unit 140, a plating module 150, a transporter 160, and a stocker 170. The plating apparatus 100 may be provided with a controller 180 for controlling the respective components of the plating apparatus 100.

The load port 110 is disposed for loading the substrate on the plating apparatus 100, and unloading the substrate therefrom. The load port 110 may be configured to dispose the mechanism such as FOUP, or allow the substrate to be transferred to/from the mechanism such as FOUP.

The substrate loaded by the load port 110 is transferred by the transfer robot 120. The transfer robot 120 is configured to be allowed to transfer the substrate to/from the load port 110, the drier 130, and the attachment/detachment unit 140. It is possible to use any other transfer mechanism besides the transfer robot 120. The description "transfer the substrate to the load port 110" in the specification involves "transfer the substrate to the mechanism such as FOUP disposed on the load port 110". The drier 130 is a member for drying the substrate.

The attachment/detachment unit 140 serves to attach the substrate to the substrate holder and/or detach the substrate therefrom. The attachment/detachment unit 140 has to be configured to accommodate both the substrate and the substrate holder which have been transferred. The attachment/detachment unit 140 is disposed at the position accessible for both the transfer robot 120 and the transporter 160.

The plating module 150 is disposed for executing the plating process (plating treatment) to the substrate. The plating module 150 includes one or more processing tanks. At least one of the processing tanks is a plating tank. For example, the plating module 150 as shown in FIGS. 1A and 1B includes 8 processing tanks, that is, a pre-washing tank 151, a pre-processing tank 152, a first rinse tank 153, a first plating tank 154, a second rinse tank 155, a second plating tank 156, a third rinse tank 157, and a blow tank 158. The plating apparatus 100 is capable of executing the predetermined process steps in the respective processing tanks in order.

The transporter 160 is configured to transfer the substrate holder to/from the attachment/detachment unit 140, the plating module 150, and the stocker 170. The transporter 160 is configured to transfer the substrate holder among the respective processing tanks (the pre-washing tank 151 to the blow tank 158). The transporter 160 includes a transporter arm 161 for suspending the substrate holder, an arm vertical moving mechanism 162 for moving the transporter arm 161 up and down, and a horizontal moving mechanism 163 for horizontally moving the arm vertical moving mechanism 162 along the row of the processing tanks. The horizontal moving mechanism 163 may be expressed as the mechanism for horizontally moving the transporter arm 161. It is to be understood that the transporter 160 is configured as an exemplified case.

The stocker 170 is configured to be allowed to store at least one substrate holder, or preferably, multiple substrate holders. Preferably, the substrate holder that does not hold the substrate is stored in the stocker 170. The substrate holder that holds the substrate may be stored in the stocker 170. The transporter 160 may be configured to transfer the substrate holder to/from the stocker 170.

<Single-Sided Holder>

Figure 2:
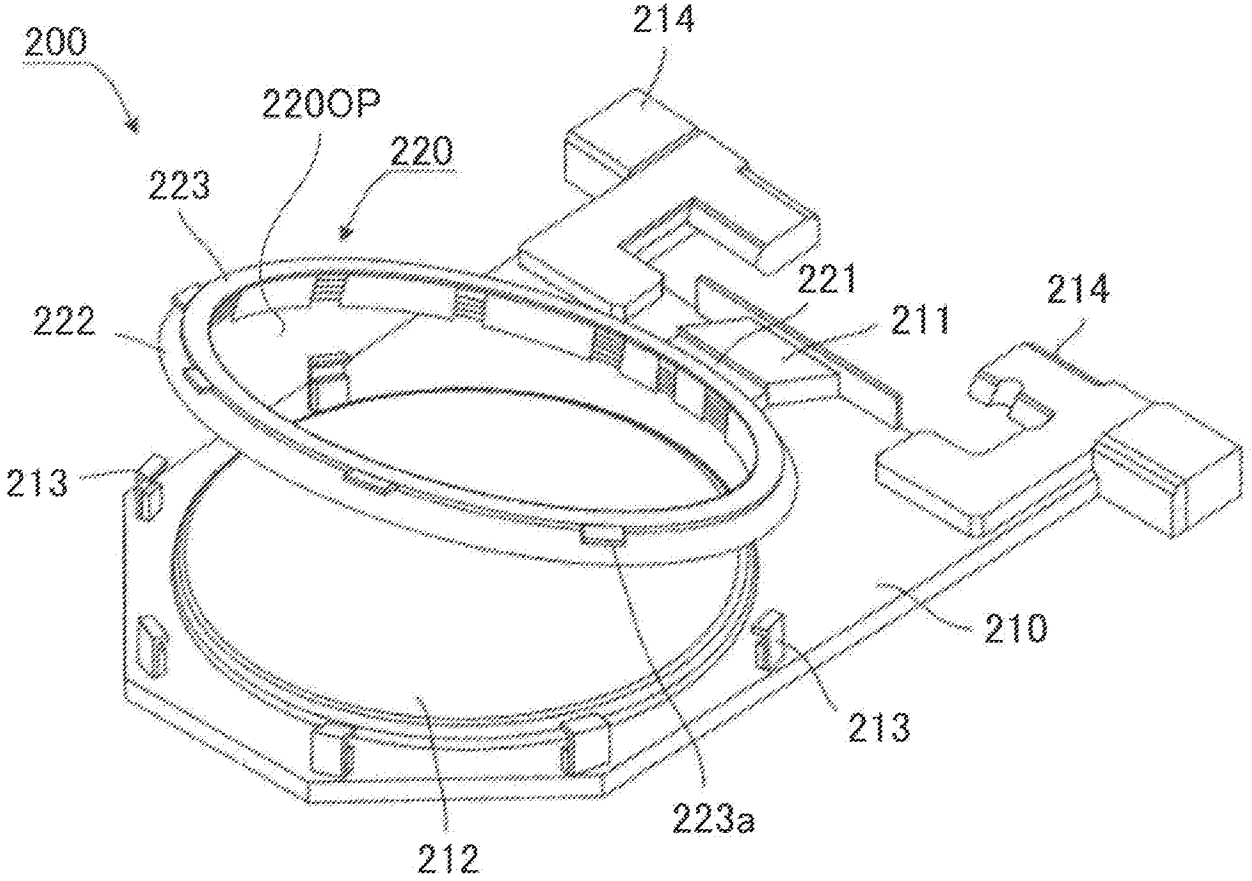
FIG. 2 is a perspective view of a substrate holder (single-sided holder) according to an embodiment.

FIG. 2 is a perspective view of a substrate holder 200 according to an embodiment. The substrate holder 200 as shown in FIG. 2 is configured to expose at least a part of the substrate on one surface. In other words, the substrate holder 200 as shown in FIG. 2 is a "single-sided holder". The substrate holder 200 includes a first holding member 210 and a second holding member 220. The substrate holder 200 as shown in FIG. 2 is a holder for holding the circular substrate. The substrate is not necessarily formed into the circular shape, but may be formed into a rectangular shape, for example. When using the substrate with the shape other than the circular shape, the shape and characteristics of the substrate holder 200 may be appropriately changed.

A substrate mount 212 for placement of the substrate is formed in substantially the center of the first holding member 210. A plurality of clampers 213 are disposed on an outer circumference of the substrate mount 212. The clamper 213 is formed to have an inwardly protruding inverted L-like shape. In the specification, the direction separating from the center of an opening 220OP in the plane parallel to the plane on which the substrate is to be positioned (plane where the substrate mount 212 is positioned in the example as shown in FIG. 2) is defined as an outward direction, and the direction approaching the center is defined as an inward direction.

A pair of handles 214 are disposed at both ends of the first holding member 210. The handle 214 may be provided with an electrode (not shown). The electrode of the handle 214 is electrically connected to the substrate via a conductive path in the substrate holder 200. The electric current required for the plating treatment is supplied from outside of the substrate holder 200 (for example, from the plating apparatus 100).

The substrate is inserted between the substrate mount 212 and the second holding member 220. The second holding member 220 may be attached to the first holding member 210 openably/closably, for example. In an example, the second holding member 220 as shown in FIG. 2 is configured to pivotally move around a hinge 211.

The second holding member 220 has the opening 220OP for exposing a part to be plated on the substrate. The second holding member 220 includes a base 221 fixed to the hinge 211, and a body 222 fixed to the base 221. The body 222 has a seal (see FIG. 4). The body 222 includes a pressing ring 223 for attachment of the body 222 to the first holding member 210. The pressing ring 223 includes a plurality of protrusions 223*a*. As the protrusion 223*a* is hooked to the clamper 213, the second holding member 220 is attached to the first holding member 210.

<Double-Sided Holder>

Figure 3A:
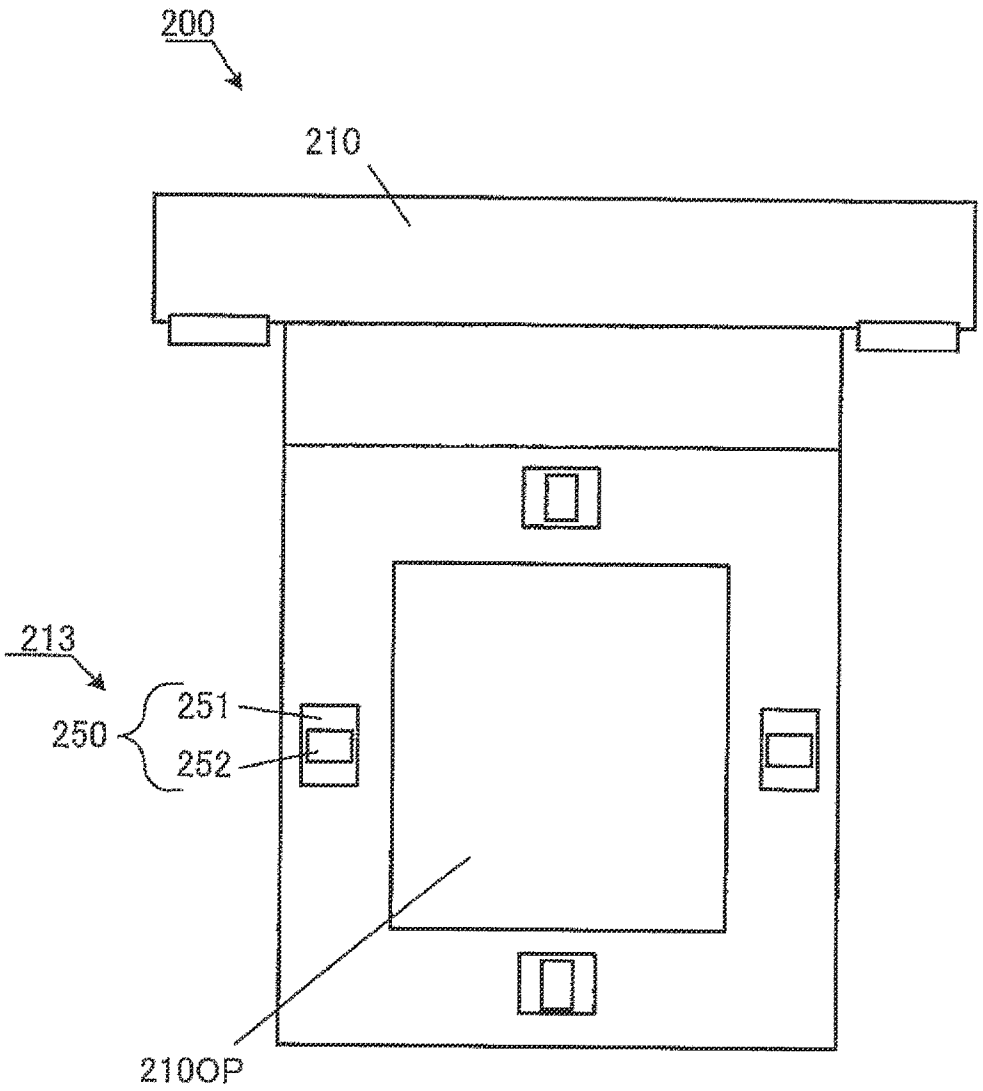
FIG. 3A is a front view of a substrate holder (double-sided holder) according to an embodiment.
Figure 3B:
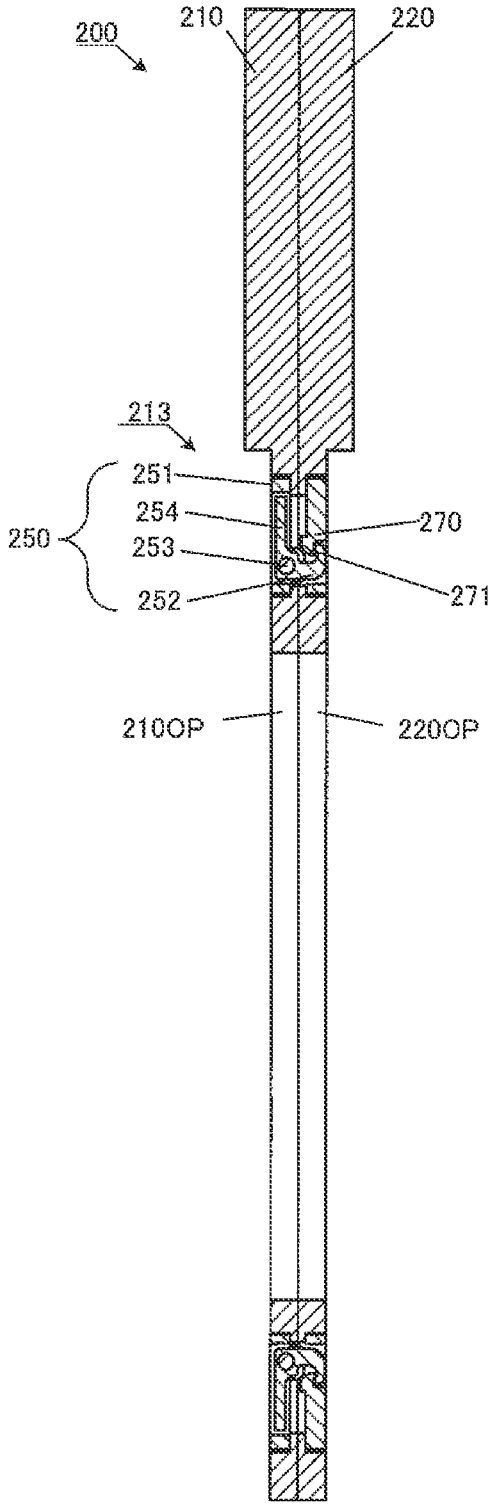
FIG. 3B is a sectional view of the substrate holder as shown in FIG. 3A.

Unlike the structure as shown in FIG. 2, the substrate holder 200 may be configured to expose at least a part of the substrate on both surfaces. That is, the substrate holder 200 may be formed as a "double-sided holder". FIG. 3A is a front view of the substrate holder 200 as the double-sided holder, and FIG. 3B is a sectional view. The substrate holder 200 as shown in FIGS. 3A and 3B is the holder for the rectangular substrate. The substrate holder 200 may be configured to hold the circular substrate.

The substrate holder 200 as shown in FIGS. 3A and 3B includes the first holding member 210 and the second holding member 220. The first holding member 210 may be referred to as a "front frame", and the second holding member 220 may be referred to as a "rear frame". It is to be understood that the "front frame" and the "rear frame" are used for the mere purpose of distinction. That is, either the front frame or the rear frame may be directed forward. The substrate is retained between the first holding member 210 and the second holding member 220. The first holding member 210 and the second holding member 220 have openings 210OP and 220OP, respectively. At least parts of surfaces of the substrate are exposed via the openings 210OP and 220OP, respectively.

The clamper 213 as shown in FIGS. 3A and 3B includes a hook 250, and a plate 270 with a claw 271. The hook 250 includes a hook base 251 and a hook main body 252. The hook main body 252 is attached to the hook base 251 via a shaft 253. Accordingly, the hook main body 252 is pivotally movable. For the pivotal movement of the hook main body 252, the hook 250 may further be provided with a lever 254. As the hook main body 252 is hooked to the claw 271, the positional relationship between the first holding member 210 and the second holding member 220 is fixed. Referring to FIGS. 3A and 3B, the first holding member 210 includes the hook 250, and the second holding member 220 includes the plate 270. It is also possible that the second holding member 220 includes the hook 250, and the first holding member 210 includes the plate 270. It is further possible that each of the first holding member 210 and the second holding member 220 includes both the hook 250 and the plate 270.

<Substrate Seal>

Figure 4:
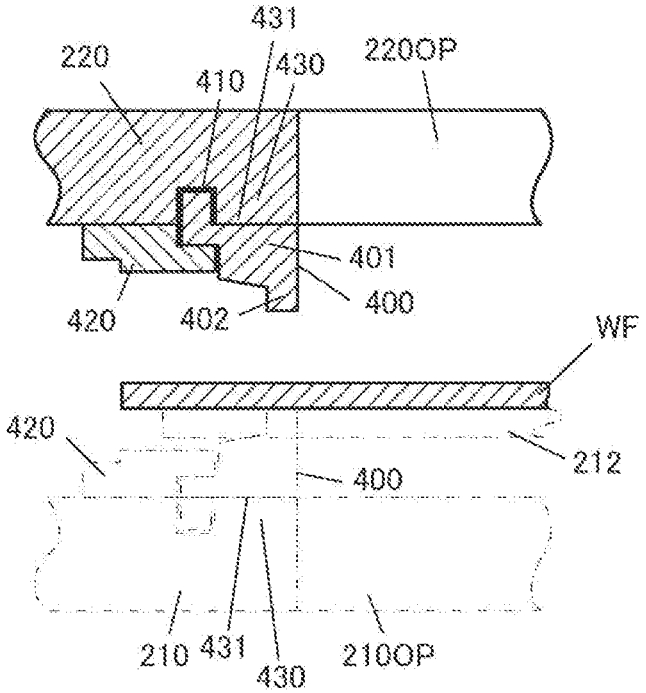
FIG. 4 is a sectional view of a periphery of a substrate seal of a conventional substrate holder.

The substrate holder 200 as shown in FIG. 2, and the substrate holder 200 as shown in FIGS. 3A and 3B include a substrate seal 400. The substrate seal 400 comes in contact with the surface that contains the part of the substrate to be exposed. The substrate seal 400 separates the part of the substrate to be exposed from the other part. FIG. 4 is a sectional view of a periphery of the substrate seal 400 of a conventional substrate holder 200.

The substrate seal 400 is attached to the first holding member 210 and/or the second holding member 220. When using the substrate holder 200 as shown in FIG. 2, in the strict sense, it will be more appropriate to express that "the substrate seal 400 is attached to the body 222 of the second holding member 220". The body 222 constitutes a part of the second holding member 220. The body 222 and the second holding member 220 will be identified as being equivalent hereinafter.

A seal support 430 having a seal support surface 431 is disposed on an outer circumference of the opening 210OP and/or the opening 220OP. The substrate seal 400 is supported with the (seal support surface 431 of) seal support 430. Preferably, the substrate seal 400 is configured not to protrude toward the opening 210OP or the opening 220OP so that the region to be exposed on a substrate WF is enlarged as wide as possible. The typical substrate seal 400 includes a seal body 401 and a seal lip 402. The seal body 401 constitutes a part in contact with the seal support surface 431. The seal lip 402 is a part in contact with the substrate WF. The seal lip 402 extends from the seal body 401, typically, from an inner end of the seal body 401. The seal lip 402 is formed to be smaller (may be expressed as "thinner" or "narrower") than the seal body 401 to facilitate a securing of seal pressure.

In an example, the (seal body 401 of) substrate seal 400 is partially attached to a mount 410 disposed to the first holding member 210 and/or the second holding member 220. The mount 410 serves to attach the substrate seal 400 to a predetermined position. The mount 410 in this example is a groove with which the substrate seal 400 is partially fitted. Accordingly, in an example, the "mount" may be referred to as a "mount groove". The mount may be formed of other than the groove. Besides the fitting, insertion (tightening) using 2 or more members, and adhesion may be carried out as the mount method. The specific structure of the mount 410 may be appropriately determined. The above-configured mount allows attachment of the substrate seal 400 to the first holding member 210 and/or the second holding member 220. In an example, the mount 410 is disposed at an outer end of the seal support 430. The structure of the mount 410 is not limited to the one as described or illustrated. Additionally or alternatively, the substrate holder 200 may be provided with a seal holder 420 for holding the substrate seal 400.

If the substrate holder 200 is the single-sided holder (see FIG. 2), the substrate WF is placed on the substrate mount 212. If the substrate holder 200 is the double-sided holder (see FIGS. 3A and 3B), the substrate WF is placed on the substrate seal 400 attached to one of the holding members (FIG. 4 shows the first holding member 210). In order to illustrate both cases in which the substrate holder 200 is the single-sided holder, and the substrate holder 200 is the double-sided holder, FIG. 4 shows both the substrate mount 212 and the substrate seal 400 attached to the first holding member 210 by imaginary lines.

As the second holding member 220 is pressed against the first holding member 210 (or the first holding member 210 is pressed against the second holding member 220), the substrate seal 400 is pressed in the direction perpendicular to the plane on which the substrate WF is to be positioned. The description "pressing the substrate seal 400 in the direction perpendicular to the plane on which the substrate WF is to be positioned" represents that "the force received by the substrate seal 400 includes at least the component of the direction perpendicular to the plane on which the substrate WF is to be positioned". Specifically, the (seal support surface 431 of) seal support 430 transmits the pressing force to the substrate seal 400.

<Declining of Seal Lip>

Figure 5:
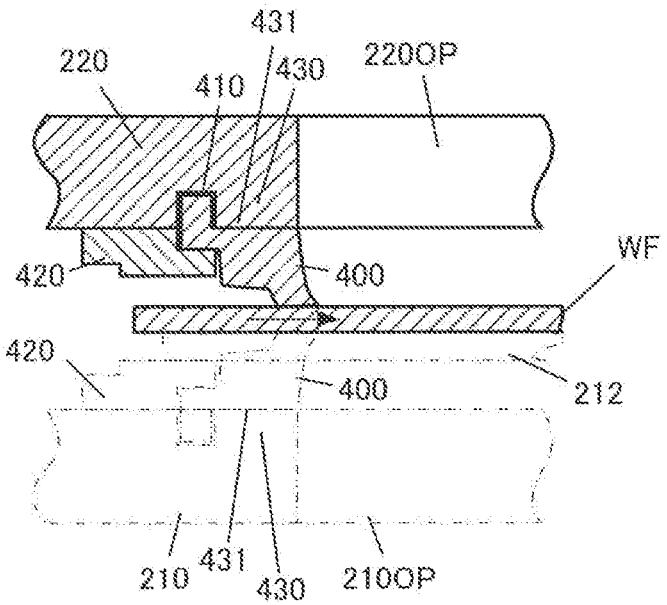
FIG. 5 is a view illustrating declining of a seal lip of the substrate holder as shown in FIG. 4 when the substrate seal is pressed.

FIG. 5 is a sectional view of the substrate holder 200, indicating declining of the seal lip 402 when the substrate seal 400 of the conventional substrate holder 200 is pressed. FIG. 5 omits several codes for convenience of illustration (see FIG. 4). As described above, the seal lip 402 extends from the inner end of the seal body 401. Meanwhile, the substrate seal 400 is supported with substantially entire surface of the seal support surface 431. Because of the asymmetric structure as described above, a starting point (position of the seal lip 402) of a vector of the force received by the substrate seal 400 from the substrate WF may be located on the inner side than a starting point of the vector (for example, substantially the center of the seal support surface 431) of the force received by the substrate seal 400 from the seal support surface 431. Accordingly, if the substrate seal 400 is pressed, the substrate seal 400 may receive the moment that moves the seal lip 402 inward, or deforms (rotates) the seal lip 402. As the seal lip 402 extends from the inner end of the seal body 401, no structure exists on the inner side than the seal lip 402. In other words, the substrate seal 400 has entirely a steep shape on the inner end. Meanwhile, structures (for example, the outer part of the seal body 401, and the seal holder 420) exist outside the seal body 401 and the seal lip 402. When the substrate seal 400 receives the moment, the seal lip 402 may decline inward. Upon "declining of the seal lip 402", typically, the seal body 401 also declines, distorts, or bends (see FIG. 5).

As the seal lip 402 declines inward, the substrate WF receives the force directed inward (arrow direction in FIG. 5). Typically, the substrate seal 400 is disposed over an entire circumference of the opening 210OP/220OP. Accordingly, the substrate WF may receive the force directed inward from substantially entire circumference of the opening 210OP/220OP. If the substrate WF with low rigidity is used, the substrate WF that receives the force directed inward may be bent and/or damaged. In an example, depending on the size, constituting material, and magnitude of the force applied to the substrate WF, in the case of the substrate WF with its thickness larger than 0 mm and equal to or smaller than 1 mm, the impact owing to declining of the seal lip may be especially conspicuous. When the substrate WF bends, electrical conditions for plating may fluctuate, leading to difficulty in execution of the plating treatment as expected.

Assuming that the substrate holder 200 is the single-sided holder, when the substrate holder 200 is immersed in the plating solution, the substrate WF receives water pressure from one direction. As the substrate WF is pressed against the substrate mount 212 under the water pressure, bending of the substrate WF may be offset. Assuming that the substrate holder 200 is the double-sided holder, the substrate WF receives water pressure from the upper and the lower surfaces. Accordingly, the use of the double-sided holder cannot offset bending of the substrate WF. In view of the above-described circumstances, the problem caused by the declining of seal lip becomes conspicuous especially when the substrate holder 200 is the double-sided holder. Even if the substrate holder 200 is the single-sided holder, bending of the substrate WF cannot be necessarily offset completely. Even if the bending of the substrate WF is completely offset, the substrate WF may still be damaged under the force applied from the substrate seal 400. Therefore, even if the substrate holder 200 is the single-sided holder, the problem caused by the declining of seal lip 402 still exists.

<Inclination of Seal Support Surface>

Figure 6:
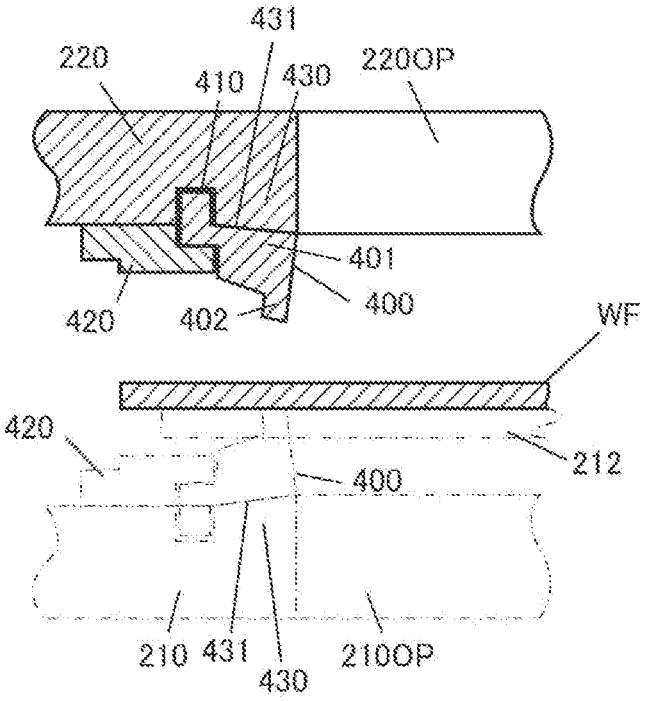
FIG. 6 is a sectional view of a substrate holder according to an embodiment.

FIG. 6 is a sectional view of the substrate holder 200 according to an embodiment. In the embodiment, the seal support 430 is inclined to prevent declining of the seal lip 402. Specifically, the seal support 430 has an inclination angle so that the inner end of the seal support 430 approaches the plane on which the substrate WF is to be positioned. The inner end of the seal support surface 431 is positioned on the inner side than the seal lip 402. As the seal support 430 is inclined, the substrate seal 400 is attached inclinedly. As a result, the seal lip 402 extends slightly outward. The substrate seal 400 as shown in FIG. 6 is equivalent to the substrate seal 400 as shown in FIG. 5. Generally, as the seal is made of an elastic body, the equivalent seal may be used in spite of difference in the shape of the attached place.

Figure 7:
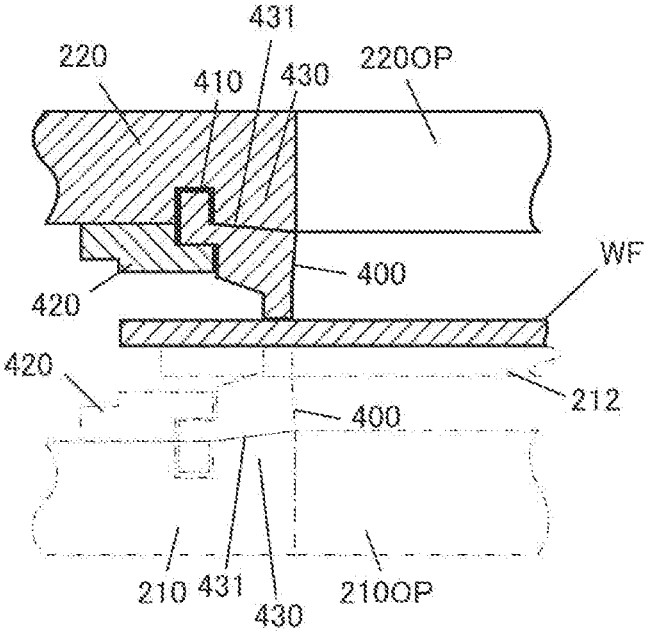
FIG. 7 is a view illustrating a state where a substrate seal as shown in FIG. 6 is pressed.

FIG. 7 shows the state where the substrate seal 400 as shown in FIG. 6 is pressed. As the seal lip 402 is directed outward because of the inclined seal support surface 431, inward declining of the seal lip 402 may be suppressed. This may suppress the substrate WF from being bent and damaged.

Preferably, the inclination angle of the seal support surface 431 corresponds to the angle at which the seal lip 402 declines outward when the substrate seal 400 is pressed. When the seal lip 402 declines outward, the substrate WF receives the force directed outward. The force directed outward becomes the one directed to pull the substrate WF. The substrate WF, thus, hardly bends. In another example, the inclination angle of the seal support surface 431 is determined so that the seal lip 402 does not decline inward or outward when the substrate seal 400 is pressed. This example is effective in that the force directed either inward or outward is hardly applied to the substrate WF. Meanwhile, as described above, the substrate seal 400 is formed as the elastic body, and accordingly is likely to be easily deformed. Even if the inclination angle is designed to prevent declining of the seal lip 402, the seal lip 402 may actually decline either inward or outward. In another example, the inclination angle of the seal support surface 431 may be determined so that the seal lip 402 declines inward. If the seal lip 402 inclines inward, it is difficult to completely exclude the possibility that the substrate WF bends. If the seal support 430 has the inclination angle as shown in FIG. 6, the inward declining amount of the seal lip 402 reduces. As a result, even in the case of the small inclination angle of the seal support surface 431, bending of the substrate WF may be reduced to a certain degree.

In an example, the inclination angle of at least a part of the seal support surface 431, for example, the inclination angle of a second section 900S to be described later may be equal to or larger than 5°, and equal to or smaller than 20°. If the seal support surface 431 is parallel to the plane on which the substrate WF is to be positioned, the inclination angle of the seal support surface 431 is assumed to be 0°.

Changing the shape of the substrate seal 400 may prevent inward declining of the seal lip 402 to be described later. Generally, however, the substrate seal 400 is formed through such techniques as molding and injection molding. It may be technically or financially difficult to form the substrate seal 400 to have the complicated shape. Meanwhile, it may be easier to incline the seal support surface 431 than change the shape of the substrate seal 400.

Referring to the example as shown in FIGS. 6 and 7, the seal support 430 is integrated with the second holding member 220. Additionally or alternatively, it is possible to use the seal support 430 as a member independent from the second holding member 220. For example, it is possible to use a wedge-shaped seal support 430.

<Structure Having Substrate Seal Provided with Protrusion>

Figure 8:
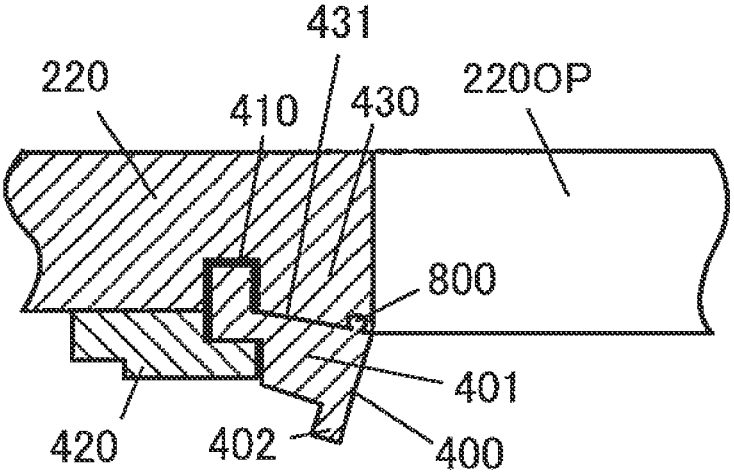
FIG. 8 is a view illustrating a substrate seal with a protrusion.

As FIG. 8 shows, the substrate seal 400 may be provided with a protrusion 800 for the purpose of preventing liquid inflow between the seal support surface 431 and the substrate seal 400. The protrusion 800 is formed on a part of the seal body 401 in contact with the seal support surface 431. The protrusion 800 is disposed at a position confronting the counterforce received by the seal lip 402 from the substrate WF. The protrusion 800 is disposed around an inner edge of the part of the seal body 401 in contact with the seal support surface 431. Being disposed at the position confronting the counterforce received by the seal lip 402 from the substrate WF, the protrusion 800 is pressed against the seal support surface 431 under the locally strong pressure. This makes it possible to prevent the liquid inflow more effectively. FIG. 8 shows that the protrusion 800 thrusts into the seal support surface 431 (or the protrusion 800 is inserted into the hole formed in the seal support surface 431). It is only for convenience of illustration of the structure. Basically, the seal support surface 431 has a smooth surface, and typically, the substrate seal 400 is softer than the seal support 430. Accordingly, the protrusion 800 never thrusts into the seal support surface 431. FIG. 8 shows the protrusion 800 rather exaggeratedly. It is to be understood that the actual protrusion 800 may be smaller than the one as illustrated in FIG. 8.

The substrate holder 200 may be configured to have the protrusion 800, if any, positioned on the inner side than a leading end of the seal lip 402. The term "the leading end of the seal lip 402" refers to the part of the seal lip 402, which is expected to come in first contact with the substrate WF. The protrusion 800 protrudes from the seal body 401. Therefore, the pressing force from the seal support 430 is transmitted to the substrate seal 400 mainly via the protrusion 800. A transmission point of the pressing force on the inner side than the leading end of the seal lip 402 may be effective in promoting outward declining of the seal lip 402.

<Difference in Inclination Angle Between a First Section and a Second Section>

Each of the opening 210OP and/or 220OP (to be simply referred to as "opening" with no codes) of the substrate holder 200 according to the embodiment has a polygonal shape (see, for example FIG. 3). Typically, the substrate holder 200 with the polygonal opening is used for holding the polygonal substrate WF.

The polygonal opening includes angular sections and side sections. The term "side section" as used herein may have the length equal to or longer than 80%, and equal to or shorter than 95% of the length of the side of the substrate to be held. The term "angular section" as used herein may be the part except the "side section", or the part except the "side section" and the "transition section" to be described later. If each length of the sides of the substrate is different from one another, each of the "side sections" of the opening may have the different length. The explanation as described above is a mere example. The criterion with respect to each length of the "angular section" and the "side section", or differentiation therebetween may be determined by factors to be described later, for example, the declining amount of the seal lip 402 and/or distortion of the substrate holder 200.

As described above, the seal support 430 and the seal support surface 431 are formed on the outer circumference of the opening. Therefore, if the opening has the polygonal shape, each of the seal support 430 and the seal support surface 431 has substantially the polygonal shape as seen from the direction perpendicular to the plane on which the substrate WF is to be positioned. As a result, the substrate seal 400 attached to the substrate holder 200 also has the polygonal shape. The substrate seal 400 as the elastic body cannot necessarily keep the polygonal shape after it is detached from the substrate holder 200.

If the opening has the polygonal shape, the inward declining amount of the seal lip 402 at the angular section is thought to be small or zero in the extreme case. As described above, if the opening has the polygonal shape, the substrate seal 400 may have the polygonal shape. When the seal lip 402 on one of the sides in contact with the angle is about to decline inward around the angular section, interference with the seal lip 402 on the other side may occur. Therefore, declining of the seal lip 402 at the angular section of the opening does not have to be regarded as being of importance, and may be negligible in the extreme case.

Figure 9:
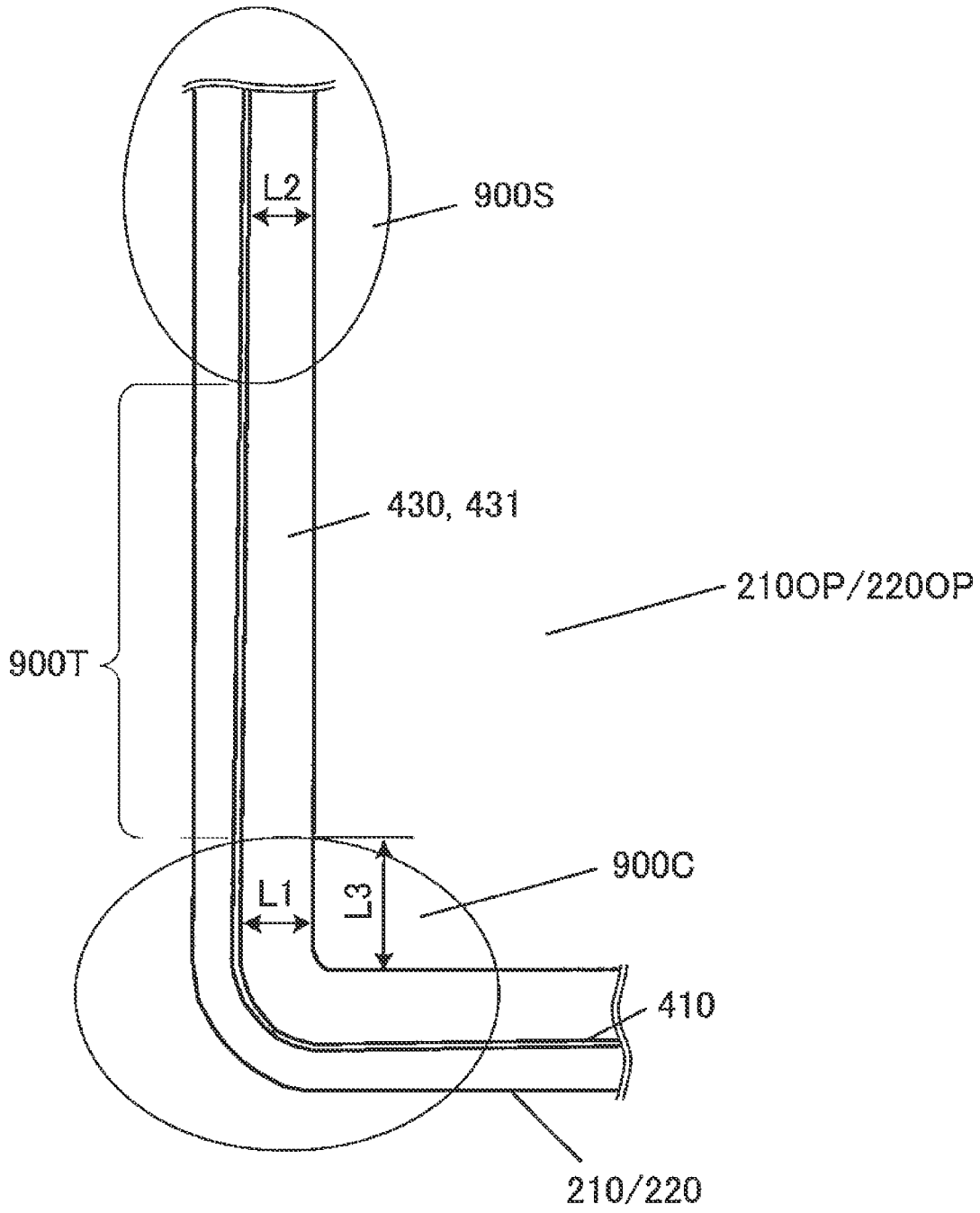
FIG. 9 is a view illustrating a first or a second holding member as seen from a direction where a seal support surface is visible.

FIG. 9 is a view of the first holding member 210 or the second holding member 220 seen from the direction where the seal support surface 431 is visible. In the case of the polygonal opening, the seal support surface 431 may be divided into at least two sections as shown in FIG. 9. That is, the seal support surface 431 may include a first section 900C corresponding to the angular section of the opening, and a second section 900S corresponding to the side section of the opening. The inclination angle of the first section 900C is smaller than the inclination angle of the second section 900S. In an example, the inclination angle of the first section 900C is 0°. In an example, the first section 900C is a part positioned in a predetermined distance (distance L3) from the position of the true "angular section". In an example, the distance L3 may be equal to or longer than 3 mm, and equal to or shorter than 10 mm.

<Transition Section>

If the inclination angle of the first section 900C is different from the inclination angle of the second section 900S, a stepped portion is generated at the boundary between the first section 900C and the second section 900S. When the stepped portion exists, it may be difficult to exhibit sufficient seal performance. The seal support 430 and the seal support surface 431 of the embodiment include a transition section 900T (third section 900T) for connecting the first section 900C and the second section 900S. The transition section 900T has its inclination angle gradually changed so as not to generate the stepped portion at the boundary between the first section 900C and the transition section 900T, and the boundary between the second section 900S and the transition section 900T. In other words, the inclination angle of the transition section 900T gradually changes so that the first section 900C and the second section 900S are smoothly connected. The transition section 900T may have its length equal to or longer than 10 mm, and equal to or shorter than 50 mm, for example.

<Distance Between Inner End of Seal Support Surface and Mount>

In association with the positional difference in the inclination angle of the seal support surface 431, the contact position between the seal lip 402 and the substrate WF may vary. If the inclination angle is 0° (see FIG. 4), and declining of the seal lip 402 is not considered, the seal lip 402 is expected to come in contact with the substrate WF just below or just above the inner end of the seal support surface 431. Meanwhile, if the seal support surface 431 is inclined (see FIGS. 6 and 7), the seal lip 402 comes in contact with the substrate WF at a side slightly outer than the inner end of the seal support surface 431. This may cause exposure of the region of the substrate WF, which is not required to be exposed, or fail to expose the region of the substrate WF, which is required to be exposed.

In the embodiment, the distance L1 is longer than the distance L2. The distance L1 herein refers to the distance between the inner end of the seal support surface 431 in the first section 900C projected to the plane on which the substrate is to be positioned, and the mount 410. The distance L2 herein refers to the distance between the inner end of the seal support surface 431 in the second section 900S projected to the plane on which the substrate is to be positioned, and the mount 410. The side section of the opening (inner end of the seal support surface 431) linearly extends from the first section 900C to the second section 900S in a plan view of the plane on which the substrate is to be positioned (consequently, the part of the substrate to be exposed is formed into a square shape or a rectangular shape, for example). Meanwhile, compared with the second section 900S, in the first section 900C, the mount is directed into the inner side of the opening. The shorter the distance between the inner end of the seal support surface 431 and the mount 410 becomes, the closer the seal lip 402 is positioned to the inner side (close to the opening). As the distance from the mount 410 to the opening is changed in accordance with the inclination angle, the change in the position of the seal lip 402 owing to inclination of the seal support surface 431 may be compensated for. That is, in spite of using the seal having each cross section of the angular section and the side section kept uniform, it is possible to linearize or substantially linearize the position at which the seal lip 402 of the seal comes in contact with the substrate WF between the angular section and the side section. The term "compensate for" as used herein is not limited to "complete compensation". The mount 410 of the transition section 900T may be configured to smoothly connect the mount 410 of the first section 900C with the mount 410 of the second section 900S. If the side section of the opening is non-linear, it may be preferable to make the distance L1 equivalent to the distance L2, or the distance L1 shorter than the distance L2.

<Distortion of Substrate Holder 200>

Figure 10:
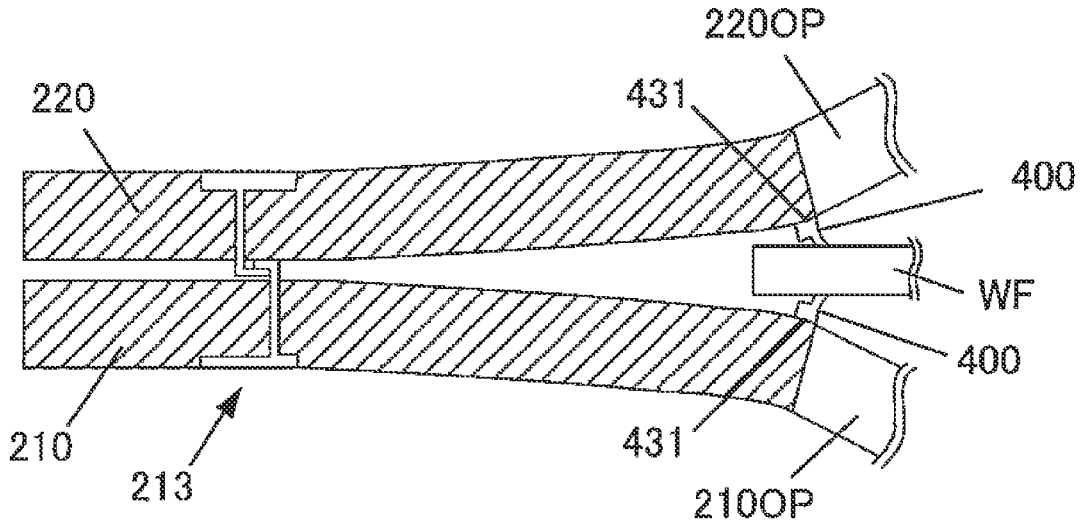
FIG. 10 is a sectional view of the substrate holder for explaining distortion thereof.

In the explanation that has been made, most members other than the substrate seal 400 are ideal rigid bodies so that no distortion occurs in the substrate holder 200. Actually, however, the ideal rigid body never exists at the time when the application has been made. Therefore, distortion may occur in the actual substrate holder 200. FIG. 10 is a sectional view of the substrate holder 200 to illustrate distortion of the substrate holder 200 only for an explanatory purpose. FIG. 10 simplifies or omits illustration of some of the members. It is to be understood that the distortion amount is shown exaggeratedly in FIG. 10. FIG. 10 shows the substrate holder 200 as the double-sided holder (see FIG. 3). It is also possible to employ the single-sided holder (see FIG. 2). FIG. 10 shows the structure with no consideration given to declining of the seal lip 402.

The first holding member 210 and the second holding member 220 are fixed by the clampers 213 while being pressed to each other. In the case of the typical substrate holder 200, the substrate seal 400 exists at a position far from the clamper 213. From a different point of view, in the typical substrate holder 200, the substrate WF presses the first holding member 210 and the second holding member 220 via the substrate seal 400. This may distort the substrate holder 200 so that the first holding member 210 is separated from the second holding member 220. Upon distortion of the substrate holder 200, the distance between the seal support surface 431 and the substrate WF becomes longer. As a result, the crushing amount (crushing margin) of the seal lip 402 may be reduced. The term "distance between the seal support surface 431 and the substrate WF" herein refers to the distance in the direction perpendicular to the surface of the substrate WF.

Figure 11:
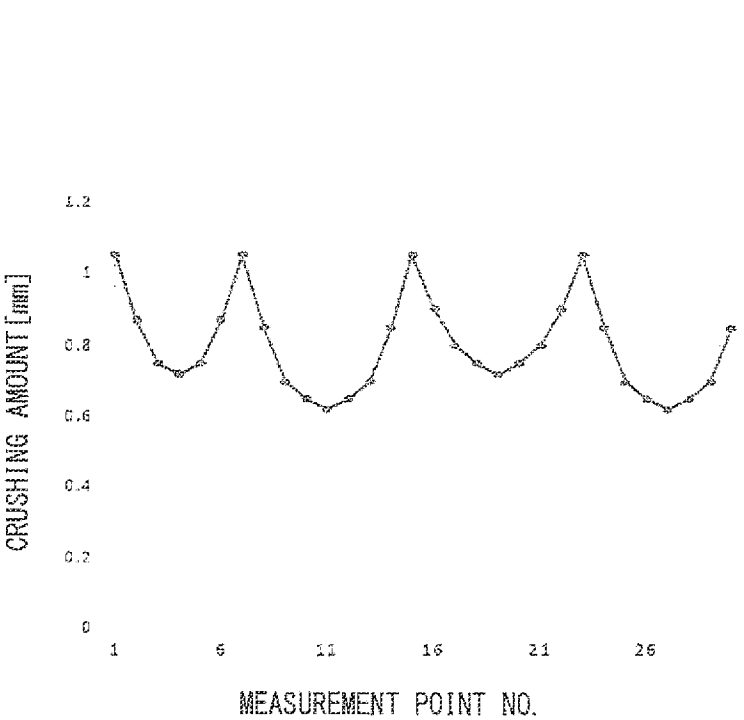
FIG. 11 is a view illustrating results of simulating position dependency of crushing amount of the seal lip of the substrate holder of certain type.
Figure 11:
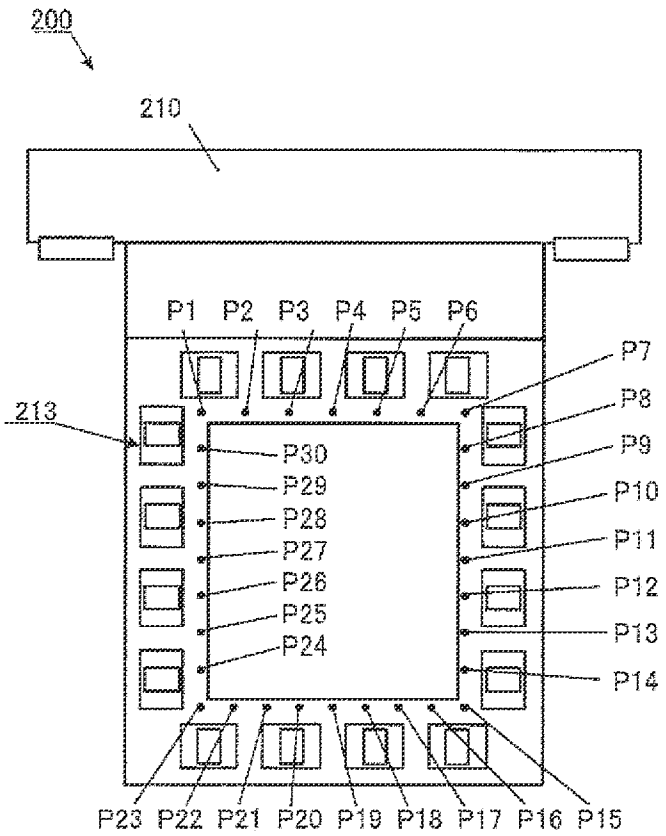

In an example, FIG. 11 shows results of simulating the position dependency of the crushing amount (crushing margin) of the seal lip 402 of the conventional substrate holder 200 in which the seal support 430 is not inclined as shown in FIG. 4. The crushing amount (crushing margin) represents the difference between the dimension of the seal in a height direction (direction perpendicular to the substrate surface) when the substrate is not held and the dimension of the seal in the height direction when the substrate is held. The substrate holder 200 as shown in FIG. 11 is equivalent to the substrate holder 200 as shown in FIG. 3 except that 16 clampers 213 (4 for each side of the opening) are provided. In this example, each crushing amount of the seal lip 402 was calculated at total 30 points from the first position P1 to the thirtieth position P30. The first position P1 to the thirtieth position P30 correspond to the respective positions of the seal lip 402.

As the graph at the right side of FIG. 11 shows, crushing amount of the seal lip 402 is increased at points on the angular sections (P1, P7, P15, P23) of the opening, respectively. On the contrary, crushing amount of the seal lip 402 is reduced at points on the side sections of the opening. Typically, the above-described phenomenon is caused by lower rigidity of the side sections of the substrate holder 200 than rigidity of the angular sections of the substrate holder 200. Variation in the crushing amount of the seal may lead to leakage of the fluid.

The substrate holder 200 according to the embodiment is configured to compensate for the change in the crushing amount of the seal lip 402, which has been caused by distortion of the substrate holder 200. As seen from the comparison between the structures as shown in FIGS. 4 and 6, inclination of the seal support surface 431 brings the seal lip 402 closer to the plane on which the substrate WF is to be positioned. As a result, the crushing amount of the seal lip 402 when the seal support surface 431 is inclined becomes larger than the crushing amount when the seal support surface 431 is not inclined. Adjustment of the inclination angle of the seal support surface 431 in accordance with the location may compensate for the change in the crushing amount of the seal lip 402.

Considering that the crushing amount of the seal lip 402 on the side section of the opening is likely to become small, the inclination angle of the seal support surface 431 at the second section 900S may be set to a large value. In this case, however, the crushing amount of the seal lip 402 on the side section of the opening is not necessarily made constantly small. Distribution of the crushing amount of the seal lip 402 is variable under various conditions, for example, rigidity of each component of the substrate holder 200, the seal pressure applied by the substrate seal 400, positions and the number of the clampers 213, and clamping strength. The distribution of the inclination angle of the seal support surface 431 may be determined in accordance with the distribution of the crushing amount of the seal lip 402. The declining direction of the seal lip 402 may be considered when determining the distribution of the inclination angle of the seal support surface 431.

<Seal Shape for Declining Prevention and Compensation of Change in Crushing Amount>

The explanation has been made on the structure in which the inclination angle of the seal support surface 431 serves to prevent declining of the seal lip 402, and/or compensate for the change in the crushing amount of the seal lip 402. Hereinafter, the explanation will be made on the structure in which the shape of the substrate seal 400 serves to prevent declining of the seal lip 402 and/or compensate for the change in the crushing amount of the seal lip 402.

As described above, the seal lip 402 is unlikely to decline around the angular section of the opening. Meanwhile, the seal lip 402 is likely to decline around the side section of the opening. In the embodiment, an extending direction of the seal lip 402 varies depending on the position.

Figure 12A:
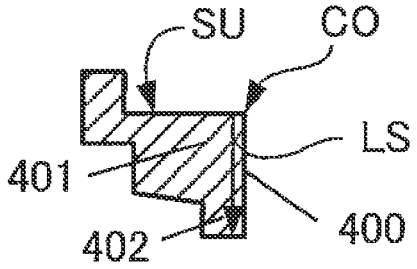
FIG. 12A is a sectional view of a substrate seal around an angular section of an opening according to an embodiment.
Figure 12B:
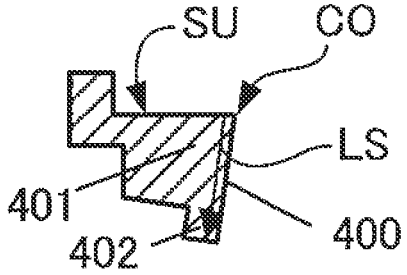
FIG. 12B is a sectional view of the substrate seal around a side section of the opening according to the embodiment.

FIG. 12A is a sectional view of the substrate seal 400 around the angular section of the opening. FIG. 12B is a sectional view of the substrate seal 400 around the side section of the opening. As shown in FIGS. 12A and 12B, the seal lip 402 around the side section of the opening may extend to the outer side compared with the seal lip 402 around the angular section of the opening. Outward extension of the seal lip 402 may prevent inward declining of the seal lip 402. Assuming that the line connecting an inner edge CO of the surface (contact surface SU) in contact with the seal support surface 431 and the leading end of the seal lip 402 is designated as LS, the line LS of the substrate seal 400 around the side section of the opening is inclined outward to the leading end of the lip seal compared with the line LS of the substrate seal 400 around the angular section of the opening. In other words, taking the inner edge CO of the surface (contact surface SU) in contact with the seal support surface 431 as reference, it may be expressed that the leading end of the seal lip around the side section of the opening is positioned at the outer side than the leading end of the seal lip around the angular section of the opening.

Furthermore, as described above, the crushing amount of the seal lip 402 around the side section of the opening is likely to be smaller than the crushing amount of the seal lip 402 around the angular section of the opening. Accordingly, in the embodiment, the height of the seal lip 402 differs in accordance with the position.

Figure 13A:
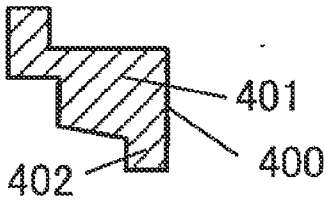
FIG. 13A is a sectional view of a substrate seal around an angular section of an opening according to an embodiment.
Figure 13B:
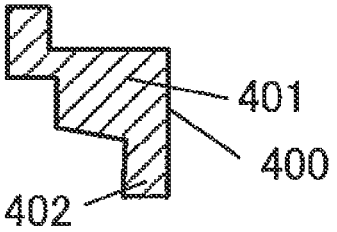
FIG. 13B is a sectional view of the substrate seal around a side section of the opening according to the embodiment.

FIG. 13A is a sectional view of the substrate seal 400 around the angular section of the opening. FIG. 13B is a sectional view of the substrate seal 400 around the side section of the opening. As shown in FIGS. 13A and 13B, the seal lip 402 around the side section of the opening may be higher than the seal lip 402 around the angular section of the opening. The change in the crushing amount of the seal lip 402 caused by distortion of the substrate holder 200 may be compensated for by adjusting the height of the seal lip 402. The term "height of the seal lip 402" refers to the distance from the bottom surface of the seal body 401 (surface in contact with the seal support surface 431) to the leading end of the seal lip 402. Changing the protrusion amount of the seal lip 402 from the seal body 401 may change the height of the seal lip 402. Meanwhile, the height of the seal lip 402 may be changed by varying the size of the seal body 401 without changing the protrusion amount of the seal lip 402.

Figure 14:
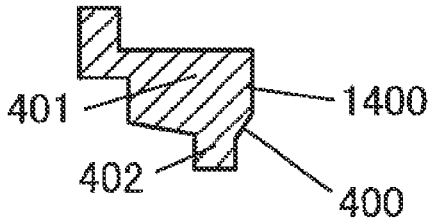
FIG. 14 is a sectional view of a substrate seal having a protrusion extending inward from a seal body.

As FIG. 14 shows, the substrate seal 400 may be provided with an extension 1400 extending inward from the seal body 401. As the extension 1400 extends inward, the moment received by the substrate seal 400 may be reduced. As the extension 1400 is disposed on the inner side than the seal lip 402, the inward deformation of the seal lip 402 becomes unlikely to occur. In this case, the seal lip 402 may extend from the inner end of the seal body 401, or any part other than the inner end of the seal body 401 such as the center thereof.

Embodiments of the present invention have been described. The embodiments are not intended to restrict the present invention, but to facilitate understanding of the invention. The present invention may be modified and improved as well as have the equivalents without departing from the scope of the invention. It is also possible to combine the respective components described in the claims and the specification arbitrarily or omit them so long as the problem as described above is at least partially solved, or the resultant effect is at least partially obtained. For example, it is possible to combine the embodiment as described referring to FIGS. 6 to 11, the embodiment as described referring to FIGS. 12A and 12B, and the embodiment as described referring to FIGS. 13A and 13B.

An embodiment according to the present application discloses a substrate holder including an opening for exposing at least a part of a substrate on at least one of surfaces. The substrate holder includes a seal which comes in contact with a surface including the part of the substrate to be exposed, and is pressed in a direction perpendicular to a plane on which the substrate is to be positioned, and a seal support which has a seal support surface for supporting the seal, and is disposed on an outer circumference of the opening. The seal includes a seal body which comes in contact with the seal support surface, and a seal lip which extends from the seal body to come in contact with the surface of the substrate to be exposed. At least a part of the seal support surface has an inclination angle which allows an inner end of the seal support surface to approach the plane on which the substrate is to be positioned. The inner end of the seal support surface is positioned on an inner side than the seal lip. In an embodiment, the seal lip extends from the inner end of the seal body.

The substrate holder as an example provides an effect of preventing inward declining of the seal lip.

In the substrate holder as an embodiment according to the present application, the inclination angle of the seal support surface is an angle at which the seal lip bends outward when the seal is pressed in the direction perpendicular to the plane on which the substrate is to be positioned.

The substrate holder as an, example provides the effect of securely preventing inward declining of the seal lip.

An embodiment according to the present application discloses the substrate holder configured to have the inclination angle of at least a part of the seal support surface equal to or larger than 5°, and equal to or smaller than 20°.

The disclosure clarifies an example of the inclination angle of the seal support surface.

An embodiment according to the present application discloses the substrate holder. In the substrate holder, the opening has a polygonal shape, the seal support surface includes a first section corresponding to an angular section of the opening, and a second section corresponding to a side section of the opening, and the seal support surface is formed to have an inclination angle of the first section smaller than an inclination angle of the second section.

The substrate holder as an example provides the effect of preventing the inward declining of the seal lip especially at the second section (the section corresponding to the side section of the opening).

An embodiment according to the present application discloses the substrate holder, in which the inclination angle of the first section is 0°.

The disclosure clarifies an example of the inclination angle of the first section.

An embodiment according to the present application discloses the substrate holder in which the seal support surface includes a transition section having its inclination angle gradually varied for connecting the first section and the second section.

The substrate holder as an example provides an effect of preventing generation of the stepped portion in a boundary between the first section and the second section.

An embodiment according to the present application discloses the substrate holder in which the side section has a length equal to or longer than 80%, and equal to or shorter than 95% of a length of a side of the substrate to be held.

The disclosure clarifies an example of the length of the side section.

An embodiment according to the present application discloses the substrate holder which includes a mount for attaching the seal to a predetermined position. The side section is linearly formed in a plan view of the plane on which the substrate is to be positioned. A distance between the inner end of the seal support surface on the first section and the mount in a plan view of the plane on which the substrate is to be positioned is longer than a distance between the inner end of the seal support surface on the second section and the mount in a plan view of the plane on which the substrate is to be positioned.

The substrate holder as an example provides an effect of compensating for change in the position of the seal lip owing to the inclined seal support surface.

An embodiment according to the present application discloses the substrate holder, in which the seal has a protrusion which is formed on a part of the seal body in contact with the seal support surface, and positioned to confront a counterforce received by the seal lip from the substrate. In an embodiment, the protrusion is formed around an inner edge of a part of the seal body in contact with the seal support surface.

The substrate holder as an example provides an effect of securely preventing an outflow of a fluid.

An embodiment according to the present application discloses the substrate holder which includes a polygonal opening for exposing at least a part of a substrate on at least one of surfaces. The substrate holder includes a seal which comes in contact with a surface that includes the part of the substrate to be exposed, and is pressed in a direction perpendicular to a plane of the substrate, and a seal support disposed on an outer circumference of the opening. The seal includes a seal body which comes in contact with the seal support surface, and a seal lip which extends from the seal body to come in contact with the surface of the substrate to be exposed. In the embodiment, (a) the seal lip around a side section of the opening extends to an outer side than the seal lip around an angular section of the opening, or (b) the seal lip on the side section of the opening is higher than the seal lip on the angular section of the opening. In an embodiment, the seal lip extends from an inner end of the seal body.

The substrate holder as an example provides effects that the seal structure serves to prevent declining of the seal lip and/or compensate for change in the crushing amount of the seal lip without being affected by inclination angle of the seal support surface.

An embodiment according to the present application discloses the substrate holder. In the substrate holder, the seal support includes a seal support surface, at least a part of the seal support surface has an inclination angle which allows an inner end of the seal support surface to approach the plane on which the substrate is to be positioned, and the inner end of the seal support surface is positioned on an inner side than the seal lip.

The disclosure clarifies that both the inclination angle of the seal support surface and the seal structure serve to prevent declining of the seal lip and/or compensate for change in the crushing amount of the seal lip.

An embodiment according to the present application discloses a plating apparatus which includes the substrate holder as any one of those described in the specification, and at least one plating tank.

The disclosure clarifies the apparatus to which the substrate holder is applied.

REFERENCE SIGNS LIST

100 plating apparatus
110 load port
120 transfer robot
130 drier
140 attachment/detachment unit
150 plating module
151 pre-washing tank
152 pre-processing tank
153 first rinse tank
154 first plating tank
155 second rinse tank
156 second plating tank
157 third rinse tank
158 blow tank
160 transporter
161 transporter arm
162 arm vertical moving mechanism
163 horizontal moving mechanism
170 stocker
180 controller
200 substrate holder
210 first holding member
210OP opening
211 hinge
212 substrate mount
213 clamper
214 handle
220 second holding member
220OP opening
221 base
222 body
223 pressing ring
223*a* protrusion
250 hook
251 hook base
252 hook main body
253 shaft
254 lever
270 plate
271 claw
400 substrate seal
401 seal body
402 seal lip
410 mount
420 seal holder
430 seal support
431 seal support surface
800 protrusion
900C first section
900S second section
900T transition section (third section)
1400 extension
WF substrate

What is claimed is:

1. A substrate holder including an opening for exposing at least a part of a substrate on at least one of its surfaces, comprising:

a seal which comes in contact with a surface including a part of the substrate to be exposed, and is pressed in a direction perpendicular to a plane on which the substrate is to be positioned; and a seal support which has a seal support surface for supporting the seal, and is disposed on an outer circumference of the opening, wherein:

the seal includes a seal body which comes in contact with the seal support surface, and a seal lip which extends from the seal body to come in contact with the surface of the substrate to be exposed;

at least a part of the seal support surface has an inclination angle which allows an inner end of the seal support surface to approach the plane on which the substrate is to be positioned;

the inner end of the seal support surface is positioned on an inner side than the seal lip, the opening has a polygonal shape;

the seal support surface includes a first section corresponding to an angular section of the opening, and a second section corresponding to a side section of the opening; and the seal support surface is formed to have an inclination angle of the first section smaller than an inclination angle of the second section.

2. The substrate holder according to claim 1, wherein the seal lip extends from an inner end of the seal body.

3. The substrate holder according to claim 1, wherein the inclination angle of at least a part of the seal support surface is an angle at which the seal lip bends outward when the seal is pressed in the direction perpendicular to the plane on which the substrate is to be positioned.

4. The substrate holder according to claim 1, wherein the inclination angle of at least a part of the seal support surface is equal to or larger than 5°, and equal to or smaller than 20°.

5. The substrate holder according to claim 1, wherein the inclination angle of the first section is 0°.

6. The substrate holder according to claim 1, wherein the seal support surface includes a transition section having its inclination angle gradually varied for connecting the first section and the second section.

7. The substrate holder according to claim 1, wherein the side section has a length equal to or longer than 80%, and equal to or shorter than 95% of a length of a side of the substrate to be held.

8. The substrate holder according to claim 1, comprising a mount for attaching the seal to a predetermined position, wherein:

the side section is linearly formed in a plan view of the plane on which the substrate is to be positioned; and a distance between the inner end of the seal support surface on the first section and the mount in a plan view of the plane on which the substrate is to be positioned is longer than a distance between the inner end of the seal support surface on the second section and the mount in a plan view of the plane on which the substrate is to be positioned.

9. The substrate holder according to claim 1, wherein:

the seal has a protrusion which is formed on a part of the seal body in contact with the seal support surface, and positioned to confront a counterforce received by the seal lip from the substrate.

10. The substrate holder according to claim 9, wherein the protrusion is formed around the inner edge of a part of the seal body in contact with the seal support surface.

11. A substrate holder including a polygonal opening for exposing at least a part of a substrate on at least one of its surfaces, comprising:

a seal which comes in contact with a surface that includes a part of the substrate to be exposed, and is pressed in a direction perpendicular to a plane on which the substrate is to be positioned; and a seal support disposed on an outer circumference of the opening, wherein:

the seal support includes a seal support surface, the seal includes a seal body which comes in contact with the seal support surface, and a seal lip which extends from the seal body to come in contact with the surface of the substrate to be exposed; and (a) the seal lip around a side section of the opening extends to an outer side than the seal lip around an angular section of the opening, or (b) the seal lip on the side section of the opening is higher than the seal lip on the angular section of the opening.

12. The substrate holder according to claim 11, wherein the seal lip extends from an inner end of the seal body.

13. The substrate holder according to claim 11, wherein:

at least a part of the seal support surface has an inclination angle which allows the inner end of the seal support surface to approach the plane on which the substrate is to be positioned; and the inner end of the seal support surface is positioned on an inner side than the seal lip.

14. A plating apparatus comprising:

the substrate holder according to claim 1; and at least one plating tank.

* * * * *